United States Patent [19]

Leifeld

[11] Patent Number: 4,930,190

[45] Date of Patent: Jun. 5, 1990

[54] APPARATUS FOR FEEDING A FIBER LAP TO A FIBER PROCESSING MACHINE

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 261,519

[22] Filed: Oct. 3, 1988

[30] Foreign Application Priority Data

Oct. 5, 1987 [DE] Fed. Rep. of Germany ..... 37336320

[51] Int. Cl.[5] ..... D01G 15/40

[52] U.S. Cl. ..... 19/105

[58] Field of Search ..... 19/105, 160, 161, 163

[56] References Cited

U.S. PATENT DOCUMENTS 3,709,406 1/1973 Binder et al. ..... 19/105

FOREIGN PATENT DOCUMENTS 1091011 4/1961 Fed. Rep. of Germany .
8525938 3/1987 Fed. Rep. of Germany .
2826101 4/1987 Fed. Rep. of Germany .
1392433 2/1965 France .
1398603 3/1965 France .
2001366 1/1979 United Kingdom .
2014206 8/1979 United Kingdom .
2182365 5/1987 United Kingdom ..... 19/105

*Primary Examiner*—Werner H. Schroeder
*Assistant Examiner*—D. Price
*Attorney, Agent, or Firm*—Spencer & Frank

[57] ABSTRACT

A textile fiber processing assembly includes a feed chute adapted to be charged with fiber material and having a bottom portion provided with a fiber outlet through which the fiber material is discharged; a fiber feeding arrangement, including a feed roller and a counterelement cooperating with the feed roller, positioned externally of the feed chute downstream of the outlet opening as viewed in a direction of advance of the fiber material upon discharge thereof from the outlet; and a textile fiber processing machine having an input and a fiber processing roller situated at the input downstream of the fiber feeding arrangement and arranged for receiving the fiber material advanced by the fiber feeding arrangement. The feed roller adjoins the outlet and is arranged for drawing fiber material from the feed chute through the outlet and advancing the fiber material to the fiber processing roller. The outlet is situated at a height level above that of the rotary axis of the generally horizontal rotary axis of the fiber processing roller.

10 Claims, 4 Drawing Sheets

APPARATUS FOR FEEDING A FIBER LAP TO A FIBER PROCESSING MACHINE

CROSS-REFERENCE TO RELATED APPLICATION

U.S. Patent Application Ser. No. 07/261,518, filed Oct. 3, 1988 and entitled LAP EVENER FOR A FIBER PROCESSING MACHINE and being the counterpart of Federal Republic of Germany Application No. P 37 33 631.2 discloses related subject matter and is incorporated herein by reference.

BACKGROUND OF THE INVENTION

This invention relates to an apparatus which is associated with a card, a roller card unit, a cleaner or a similar textile fiber processing machine and serves for advancing the fiber lap to the fiber processing machine. A fiber tuft feeding device, such as a feed chute is associated with the fiber processing machine and is arranged upstream thereof, as viewed in the feed direction of the fiber material. The apparatus includes a feed roller which advances the fiber material to a processing roller at the input of the fiber processing machine. With the feed roller there cooperates a counterelement such as a feed table or a counterroller.

According to a known arrangement, between the lower end of the feed chute and the feed roller of the fiber processing machine, such as a carding machine, a transfer element, such as a transfer tray, is arranged for the fiber lap. The transfer element deflects the fiber lap from a vertical orientation (as it leaves the feed chute) into an approximately horizontal position. This change of orientation alters the inner construction of the fiber lap. Further, deflecting, guiding and compressing elements are present which adversely affect the uniformity of the fiber lap.

SUMMARY OF THE INVENTION

It is an object of the invention to provide an improved fiber lap advancing device of the above-outlined type from which the discussed disadvantages are eliminated and which, in particular, provides for a greater uniformity of the fiber lap.

This object and others to become apparent as the specification progresses, are accomplished by the invention, according to which, briefly stated, the lower end of the feed chute ends in the zone of the feed roller of the fiber processing machine, whereby the feed roller draws the fiber material from the feed chute and further, the outlet end of the feed chute terminates at a height level above that of the center of the opening roller of the fiber processing machine, such as the licker-in of a carding machine.

Thus, according to the invention, components such as an intermediate element, a transfer tray, a support roller or the like which are conventionally arranged between the discharge end of the feed chute and the feed roller are dispensed with. The drawing and transporting function of the feed roller/counterelement assembly is assisted by gravity acting on the fiber lap, as well as by the fiber tuft densifying (compressing) device situated in the lower, or feed chute of a two-chute card feeder. By virtue of the fact that the conventional deflecting, guiding and compressing elements are omitted according to the invention, the usual multiple shifts within the fiber lap which cause structural changes and irregularities in the fiber lap, can no longer occur.

It is known, for example, that the extent of draft between the delivery rollers at the bottom of the feed chute and the feed roller associated with the card has a significant effect on the uniformity of the sliver produced by the card: thus, unfavorable drafts may cause significant errors. The invention eliminates the sources of such errors. Even in case of a favorable draft, reorientations occur which are eliminated by the invention. The fiber lap is admitted in a more uniform state (considered both over a time period and along the width of material at any given time) to the opening roller of the fiber processing machine, such as the licker-in of a card. A uniform advance of the fiber lap throughout its width is ensured by the fact that the transporting device, that is, the feed roller, is situated in the immediate vicinity of the opening roller (licker-in). This arrangement results in better Uster values and CV values.

By virtue of the fact that the terminus of the fill chute is situated above the height level of the licker-in axis, the possibility is provided that given the same diameter of the licker-in, a greater number of knives and stationary carding segments may be arranged along its circumferential surface, whereby the cleaning and stripping effects are improved. If the diameter of the licker-in is reduced, then, given the same circumferential velocity, a higher rpm is feasible. This results in a higher centrifugal force whereby the separation of trash and other impurities is improved. The apparatus according to the invention is structurally simple and permits a very compact arrangement of components.

The invention has the following additional advantageous features:

The end of the feed chute is arranged laterally above the licker-in.

The end of the feed chute is arranged substantially vertically above the licker-in.

The feed chute is displaceable, for example, laterally swingable.

The feed chute is displaceable, for example, laterally swingable, together with the feed roller.

At least one chute wall is provided with air outlet openings in the lower end zone of the feed chute.

DESCRIPTION OF THE PREFERRED EMBODIMENTS

Figure 1:
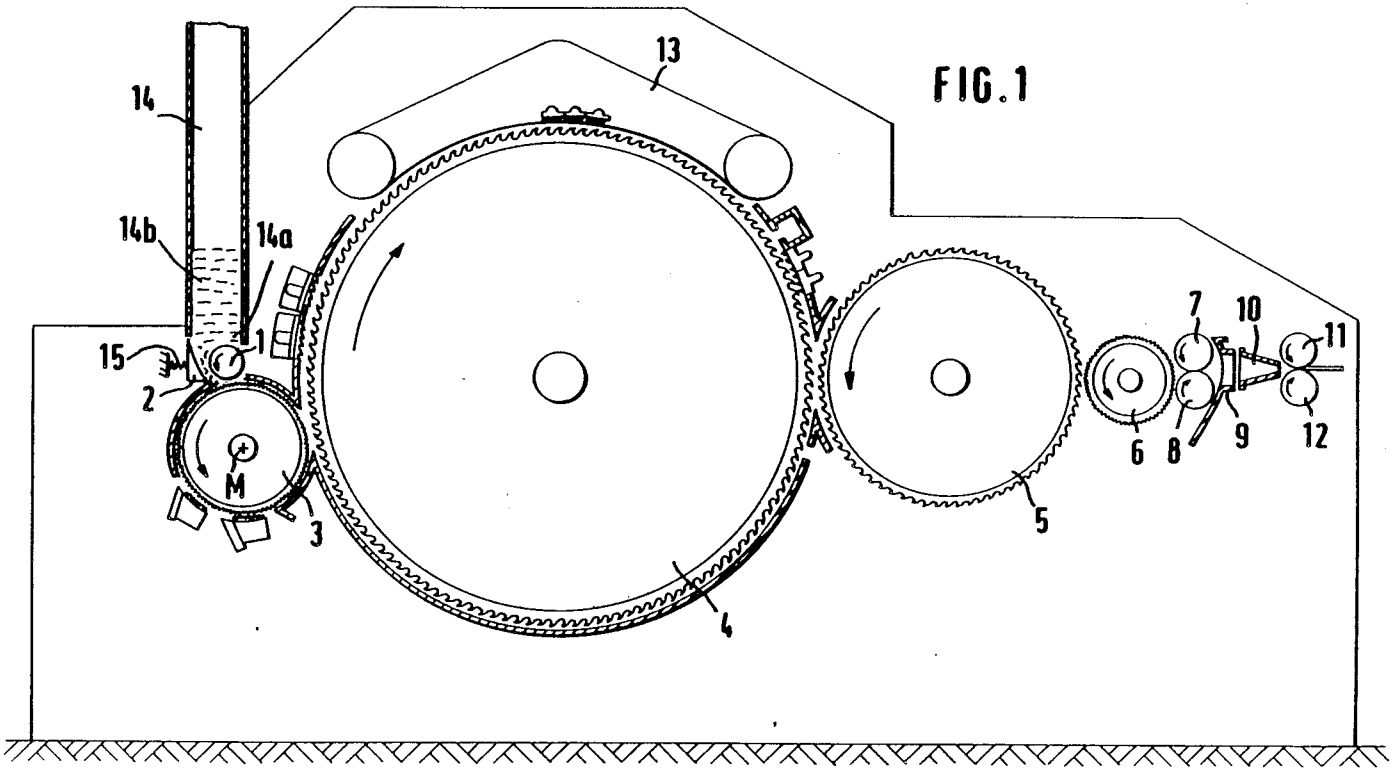
FIG. 1 is a schematic side elevational view of a carding machine, incorporating a preferred embodiment of the invention.

Turning to FIG. 1, there is illustrated therein a carding machine, which may be, for example, an EXACTACARD DK 715, manufactured by Trützschler GmbH and CO. KG, Mönchengladbach, Federal Republic of Germany. The carding machine has a feed roller 1, a feed table 2 cooperating therewith, a licker-in 3, a main carding cylinder 4, a doffer 5, stripping rollers 6, crushing rollers 7 and 8, a fiber web guiding element 9, a sliver trumpet 10, calender rollers 11 and 12 as well as travelling flats 13 cooperating with the carding cylinder 4.

A fiber tuft feeder 14 which may be an FBK model manufactured by Trützschler GmbH & Co. KG is arranged upstream of the carding machine.

The feed roller 1 is radially immovably supported and cooperates with the movably supported feed table 2 which is urged towards the feed roller 1 by means of a spring 15. The lower chute end 14*a* terminates in the zone of the feed roller 1 so that the feed roller 1 may draw the fiber material 14*b* from the feeder 14. The discharge end 14*a* of the feeder 14 terminates above the rotary axis M of the licker-in 3, laterally slightly offset relative to a vertical plane containing the axis M.

Figure 2:
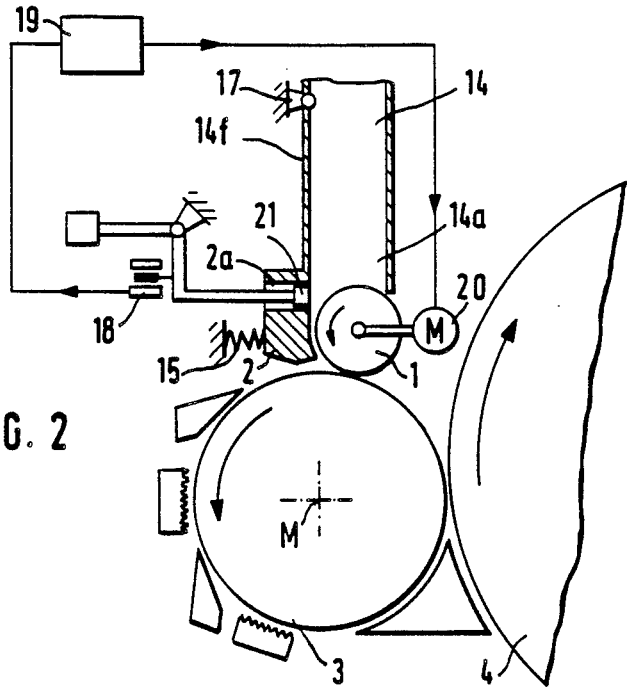
FIGS. 2–6 are diagrammatic side elevational views of five further preferred embodiments of the invention.

According to the embodiment illustrated in FIG. 2, the feeder 14 is arranged above the licker-in 3. The lower zone of the chute wall 14*f* is attached to a hinge 17 whereby the chute may swing about a horizontal axis. The spring 15 urges the chute 14 counterclockwise, that is, towards the feed roller 1. The lower end of the feed chute wall 14*f* is formed as the feed table 2 which cooperates with the feed roller 1. The gap between the feed roller 1 and the feed table 2 is oriented approximately vertically above the rotary axis M of the licker-in 3.

A short-term fiber lap regulation is achieved by providing a measuring member, such as an inductive path sensor 18 which generates signals representing the excursion of the feed table 2. The excursions, in turn, are a function of the fiber quantities passing through the clearance defined between the feed roller 1 and the feed table 2. The signals generated by the inductive path sensor 18 are applied to a control device 19 which, in turn, applies a control signal to a drive motor 20 which rotates the feed roller 1. The feed table 2 is provided with a throughgoing aperture 2*a* in which there is arranged a sensor element 21 which contacts the fiber material and to which the path sensor 18 is attached.

Figure 3:
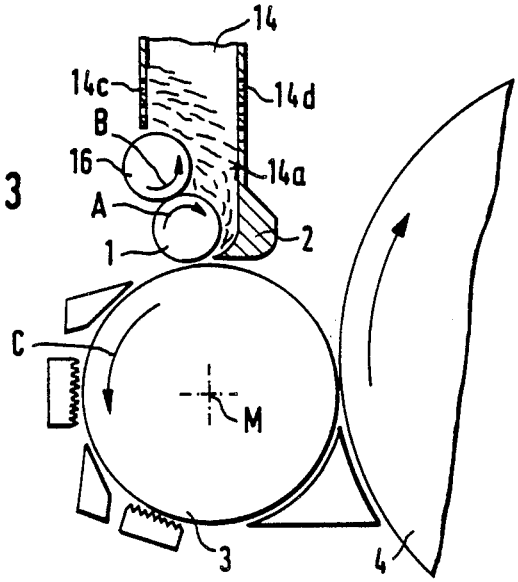

Turning to the embodiment illustrated in FIG. 3, in the zone of the discharge end (lower end) 14*a* of the feed chute 14 there are provided two series of oppositely located air outlet openings 14*c* and 14*d*. The feed roller 1 and a counterroller 16 which are arranged at the discharge end of the feed chute 14 rotate in the direction of arrows A and B, respectively. By virtue of the fact that the feed roller 1 rotates in an opposite sense relative to the direction of rotation C of the licker-in 3, these rollers rotate codirectionally in the gap zone defined by the feed roller 1 and the licker-in 3, to effect a codirectional feed of the fiber lap. The gap between the feed roller 1 and the feed table 2 is situated substantially vertically above the rotary axis M of the licker-in 3.

Figure 4:
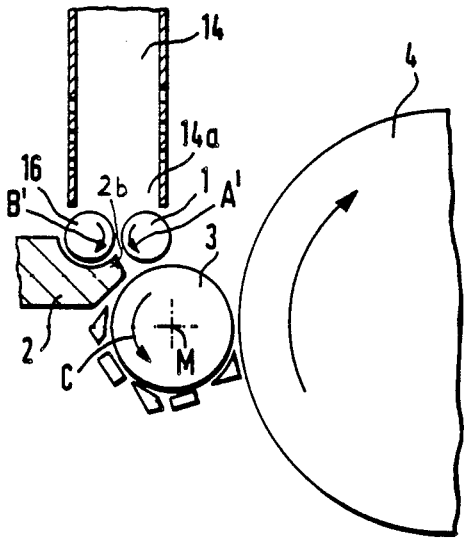

Turning now to the embodiment shown in FIG. 4, at the lower discharge end of the feed chute 14 the feed roller 1 and the counterroller 16 are arranged horizontally next to one another. The feed roller 1 rotates counterclockwise in the direction of the arrow A' while the counterroller 16 rotates clockwise as indicated by the arrow B'. By virtue of the fact that the feed roller 1 and the licker-in 3 both rotate counterclockwise, in the gap defined between the two roller components the latter move in opposite directions and therefore a counterrun fiber lap feed is achieved. Further, the feed table 2 is provided with a concave recess accommodating a peripheral part of the counterroller 16. The terminal nose portion 2*b* of the feed table 2 cooperates with the feed roller 1. The gap between the feed table 2 and the feed roller 1 is situated laterally above the rotary axis M of the licker-in 3.

Figure 5:
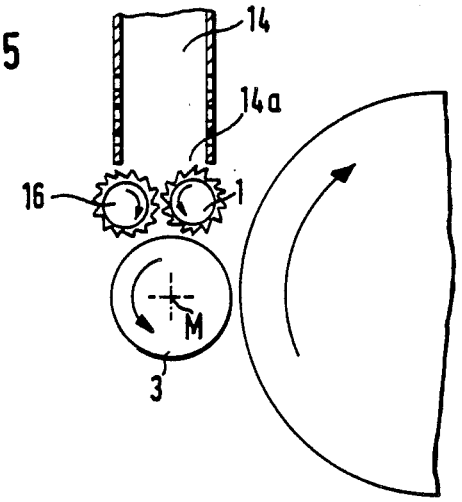

Turning now to the embodiment illustrated in FIG. 5, there is shown a two-roller feed used, for example, in roller card units. Both feed rollers 1 and 16 have a withholding or retaining clothing, that is, the teeth of the clothing are oriented in a direction opposite to the direction of advance of the fiber material. The gap between the two rollers 1 and 16 is situated approximately vertically above the rotary axis M of the licker-in 3.

Turning to the embodiment shown in FIG. 6, the counterroller 16 is situated laterally below the feed roller 1. The feed table 2 has a concave portion 2*c* which conforms to a peripheral portion of the counterroller 16. The lower zone 14*e* of the feed chute 14 is pivotal in the direction of the arrow D about a horizontal axis on a rotary joint 17 into and out of the dash-dotted position 14'. While in the described embodiment the feed roller 1 is moved together with the feed chute 14 into the phantom-line position 1' and similarly, the counterroller 16 moves into the phantom-line position 16', by virtue of their being supported by the feed chute portion 14*e*, it is feasible to arrange the two rollers immovably. The gap between the feed roller 1 and the feed table 2 is situated laterally above the rotary axis M of the licker-in 3.

Figure 6:
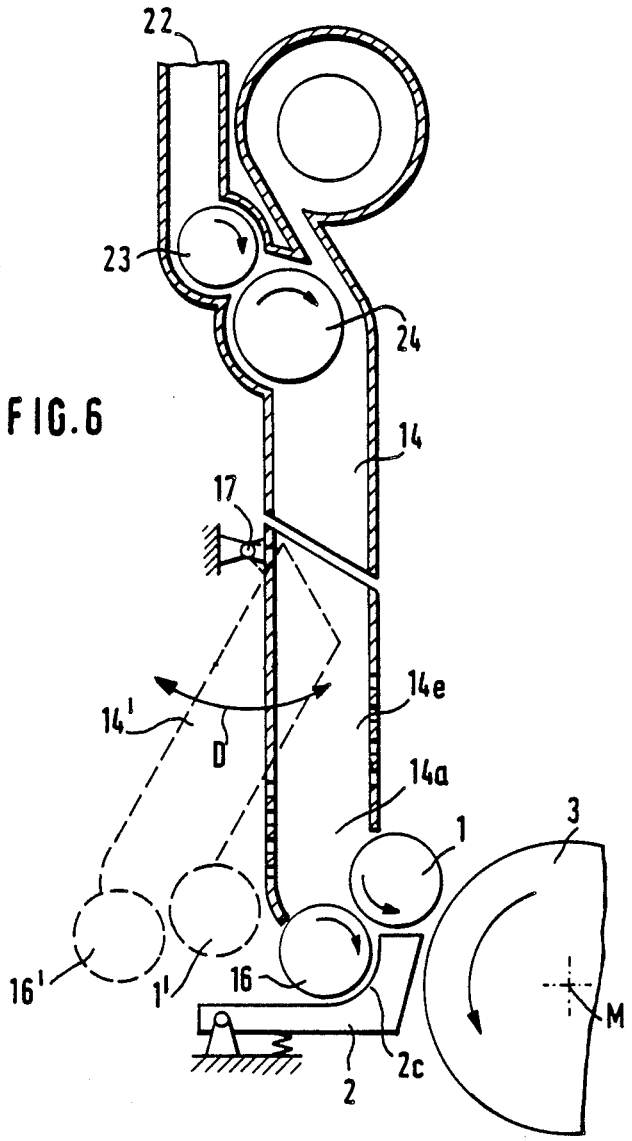

The FIG. 6 embodiment shows a two-chute fiber tuft feeder in which the lower feed chute 14 and the upper, reserve chute 22 are provided between which there is situated a slowly rotating supply roller 22 and a rapidly rotating opening roller 24.

The present disclosure relates to subject matter contained in Federal Republic of Germany Patent Application No. P 37 33 632.0 (filed Oct. 5th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a textile fiber processing assembly including a feed chute adapted to be charged with fiber material and having a bottom portion provided with an outlet opening through which the fiber material is discharged;

a fiber feeding arrangement positioned externally of the feed chute downstream of the outlet opening as viewed in a direction of advance of the fiber material upon discharge thereof from said outlet opening; said fiber feeding arrangement including a feed roller and a counterelement cooperating with the feed roller; and a carding machine having an input and a licker-in situated at said input downstream of said fiber feeding arrangement and arranged for receiving the fiber material advanced by said fiber feeding arrangement; said licker-in having a generally horizontal axis of rotation;

the improvement wherein said feed roller adjoins said outlet opening for drawing fiber material from the feed chute through said outlet opening; further wherein said feed roller immediately adjoins said licker-in for advancing the fiber material to said licker-in; and further wherein said outlet opening is situated at a height level above that of said rotary axis.

2. A textile fiber processing assembly as defined in claim 1, wherein said outlet opening is situated laterally above said rotary axis.

3. A textile fiber processing assembly as defined in claim 1, wherein said outlet is opening situated substantially vertically above said rotary axis.

4. A textile fiber processing assembly as defined in claim 1, further comprising means defining a plurality of air outlet openings provided in said feed chute in the vicinity of said outlet opening.

5. A textile fiber processing assembly as defined in claim 1, wherein said feed chute has a lower terminal length portion; the improvement further comprising mounting means for displaceably supporting said lower terminal length portion.

6. A textile fiber processing assembly as defined in claim 5, wherein said mounting means comprises a hinge for pivotally supporting said lower terminal length portion for a swinging motion about a horizonal axis.

7. A textile fiber processing assembly as defined in claim 5, wherein said feed roller is mounted on said lower terminal length portion, whereby said feed roller is displaceable as a unit with said lower terminal length portion.

8. In a textile fiber processing assembly including a feed chute adapted to be charged with fiber material and having a bottom portion provided with an outlet opening through which the fiber material is discharged; said feed chute having a lower terminal length portion;

a fiber feeding arrangement positioned externally of the feed chute downstream of the outlet opening as viewed in a direction of advance of the fiber material upon discharge thereof from said outlet opening; said fiber feeding arrangement including a feed roller and a counterelement cooperating with the feed roller; and a textile fiber processing machine having an input and a fiber processing roller situated at said input downstream of said fiber feeding arrangement and arranged for receiving the fiber material advanced by said fiber feeding arrangement; said fiber processing roller having a generally horizontal axis of rotation;

the improvement wherein said feed roller adjoins said outlet opening and is arranged for drawing fiber material from the feed chute through said outlet opening and advancing the fiber material to said fiber processing roller; and further wherein said outlet opening is situated at a height level above that of said rotary axis;

the improvement further comprising mounting means for displaceably supporting said lower terminal length portion.

9. A textile fiber processing assembly as defined in claim 8, wherein said mounting means comprises a hinge for pivotally supporting said lower terminal length portion for a swinging motion about a horizontal axis.

10. A textile fiber processing assembly as defined in claim 8, wherein said feed roller is mounted on said lower terminal length portion, whereby said feed roller is displaceable as a unit with said lower terminal length portion.

* * * * *